United States Patent [19]

Ballantine

[11] 4,389,197

[45] Jun. 21, 1983

[54] WATER-GOING VESSEL

[76] Inventor: James S. Ballantine, 121 N. Shore Rd., Absecon, N.J. 08201

[21] Appl. No.: 185,940

[22] Filed: Sep. 10, 1980

[51] Int. Cl.[3] ..... B63H 5/12; B63H 11/02

[52] U.S. Cl. ..... 440/38; 440/60; 310/57

[58] Field of Search ..... 440/38–47, 440/53, 58, 59, 60, 67, 6; 114/280, 278, 283, 288, 56, 65 R, 68, 69; 60/221, 222, 226 R, 269; 415/60, 68, 77, 91, 122 A; 417/244, 424; 9/6 P; 310/87, 57

[56] References Cited

U.S. PATENT DOCUMENTS

| | | | |
|---|---|---|---|
| 2,611,797 | 9/1952 | Beckwith et al. | 310/57 |
| 3,143,972 | 8/1964 | Smith et al. | 440/47 |
| 3,293,461 | 12/1966 | Vemura et al. | 310/57 |
| 3,574,477 | 4/1971 | Dolf et al. | 415/60 |
| 3,685,926 | 8/1972 | Blum | 417/424 |
| 3,798,690 | 3/1974 | Moore | 9/6 P |

FOREIGN PATENT DOCUMENTS

| | | | |
|---|---|---|---|
| 1217237 | 5/1966 | Fed. Rep. of Germany | 440/38 |
| 1559402 | 3/1969 | France | 440/40 |
| 126047 | 5/1919 | United Kingdom | 114/68 |
| 169760 | 10/1921 | United Kingdom | 114/68 |

*Primary Examiner*—Sherman D. Basinger
*Assistant Examiner*—Jesús D. Sotelo
*Attorney, Agent, or Firm*—Thomas C. Naber

[57] ABSTRACT

A water-going vessel having a plurality of water intake turbines extendible and retractable in unison beneath the underside of the vessel. Hull construction pieces preferably comprise a plurality of hollow spheres sandwiched within containment walls, with each sphere in contact with and secured to every adjacent sphere thereto, and further secured to touching containment walls. One preferred turbine has, in sequence, (1) two water intake tunnels having disposed therein rotatable independently controllable tandemly disposed blade groups which spiral water there through in inwardly projecting angles; (2) a mixing chamber wherein water angularly exiting each tunnel collides and proceeds linearly; (3) a venturi constriction passage wherein gas is introduced into water traveling there through; and (4) an exit passage wherein gas is introduced into water traveling there through. A second preferred turbine provides one water intake tunnel having disposed therein blade groups as above-described, introduction of additional water aft of each blade group, and venturi construction and exit passages as above-described. Blade groups are preferably comprised of a plurality of blades attached to a rotor of an alternating current variable frequency submersible electric motor. The turbines operate on a projectile principle and maintain the hull of the vessel above water during cruise.

41 Claims, 15 Drawing Figures

WATER-GOING VESSEL

BACKGROUND OF THE INVENTION

This invention relates to a water-going vessel selectively operable as both a water-displacement vessel with its underside beneath the water line and also as an above-water vessel with its underside above the water line.

Present day water-going vessels can be generally classified into three types in relation to their respective principles of operation. One such type is the hover craft which depends on a lifting force (much the same as a helicopter) and a horizontal driving force. In reality, then, a hover craft in operation is not a water-going vessel, per se, since it finds utility above the water line. The second type of vessel is the hydrofoil craft which operates on a principle much the same as an airplane in that foils disposed below the water line depend on reactive forces of the water as the foil travels through said water to create pressure differentials above and below the foil and achieve lift of the craft. The third type of vessel, and the most common, is the displacement vessel. A displacement vessel displaces a greater mass of water than its own mass, and therefore remains afloat in the water. One or more rotating propellers disposed beneath the water line drive the vessel, while a controllable rudder determines vessel direction.

Both the hover craft and the hydrofoil craft can achieve relatively high velocities, but are not efficient or practical for high load capacities found in displacement vessels. Conversely, while displacement vessels can be sized for high load capacities, such vessels can attain only relatively low velocities. It is readily apparent, therefore, that a need exists for a high load capacity water-going vessel which can also efficiently attain relatively high velocities and provide effective transporation for both passengers and cargo. Such a vessel is the subject of the instant invention.

SUMMARY OF THE INVENTION

The subject of the instant invention is a water-going vessel having a plurality of water intake turbines each of which is mounted on elevator means extending from the underside of the vessel, with each of said turbines additionally vertically pivotally mounted to said elevator means near the longitudinal midpoint of each turbine and having means for independent pivotal control, and further with the elevator means having failsafe pantographic connection means to each of said turbines for simultaneous extension and retraction of said turbines in unison.

Hull construction pieces (beams, side walls, decks, and the like) of the vessel preferably comprise a plurality of hollow spheres sandwiched within containment walls wherein adjacent spheres are in contact with each other, with each sphere of said plurality secured to each touching sphere adjacent thereto and further with each sphere which is in contact with a containment wall secured to said containment wall. An inert filler material having a density less than that of the spheres preferably occupies all space within the containment walls not occupied by spheres. Said filler material provides waterproofing, sound and heat insulation, and added buoyancy. Because a sphere is the singular shape which provides equal strength in all directions, and because of the relative lightness of weight of a sphere as contrasted to solid-plate iron or steel as currently commonly used, said sphere-containing construction pieces are preferably utilized here to achieve greater load capacity which otherwise would be expanded in the weight of traditional construction materials. Since all adjacent spheres are secured to and touch each other, forces are equally distributed among all spheres within the construction piece upon which forces impinge.

One embodiment of a preferred turbine comprises:

a. first and second water intake tunnels with each of said tunnels having disposed therein a plurality of individual tandemly disposed rotatable water-deflecting radiating blade groups spaced from each other with each blade group having immediately aft thereof a venturi constriction space and with each blade group having means to independently control individual rotation velocities thereof, and preferably wherein in the first tunnel the blade groups rotate in one direction to expandingly spiral water in an inwardly projecting angle and in the second tunnel the blade groups rotate in the opposite direction to expandingly spiral water in an inwardly projecting angle;

b. a mixing chamber aft of the first and second tunnels wherein water exiting from the first and second tunnels collides;

c. a venturi constriction passage aft of said mixing chamber, wherein said passage can have means to introduce gas under pressure into water passing there through; and d. an exit passage aft of the venturi constriction passage, said exit passage having means to introduce gas under pressure into water passing there through.

Preferably, means can be included (1) to introduce gas under pressure along the surface of the wall of the aft portion of the mixing chamber and thus reduce friction between water traveling there through and said wall; (2) to introduce gas under pressure along the surface of the outside wall of the turbine itself and thus reduce friction between the water through which the turbine is traveling and said outside wall; and (3) to control direction of water exiting the turbine, said direction control means disposed in the exit passage of the turbine. The first and second water intake tunnels can be parallel to each other, or, properly sized, concentric with each other. In the latter configuration, of course, the blade groups are likewise concentric with each other.

A second embodiment of a preferred turbine comprises:

a. a water intake tunnel having disposed therein a plurality of individual tandemly disposed rotatable water-deflecting radiating blade groups spaced from each other with each blade group having immediately aft thereof a venturi constriction space and with each blade group having means to independently control individual rotation velocities thereof;

b. means for delivering additional water immediately aft of each respective blade group;

c. a venturi constriction passage aft of the final blade group, wherein said passage can have means to introduce gas under pressure into water passing there through; and d. an exit passage aft of the venturi constriction passage, said exit passage having means to introduce gas under pressure into water passing there through.

In said second embodiment means are preferably included (1) to deliver said additional water aft of each respective blade group at essentially the same velocity as that velocity of water discharged from said respective blade group; (2) to control direction of water exiting the turbine, said direction control means disposed in the exit passage of the turbine; and (3) to introduce gas under pressure along the surface of the outside wall of the turbine itself to thereby reduce friction between water through which the turbine is traveling and said outside wall.

In each of the above-described preferred turbine embodiments the individual blade groups are preferably comprised of a plurality of blades attached to a rotor of an independently controllable alternating current variable frequency submersible electric motor having said rotor and a stator as commonly configured. As is known, heat is generated in the stator as well as in the rotor of any electric motor so configured. While some cooling of the stator and superb cooling of the rotor occurs simply because the motors are submersed in cooler water, a preferred motor has disposed within the stator heat exchange means for additional cooling of said stator. When electric motor are employed, a mere selected variation of frequency to as many of such motors as desired will alter rotation speed of corresponding blade groups. Further, of course, employment of electric motors eliminates underwater gears, fuel lines, and the like.

The elevator means earlier recited operates (1) to extend the turbines and thus dispose them a distance from the underside of the vessel, and (2) to retract the turbines toward the underside of the vessel. Where reduced speeds are required, as in docking procedures for example, the turbines are fully retracted and the vessel operates in water on a displacement principle. Conversely, when the vessel is cruising in open water, the turbines are extended a sufficient distance to permit the underside of the vessel to be above water. The magnitude of extension below the underside of the vessel is determined by the sea state or wave height so that the turbines operate on the floor of the waves to thereby take advantage of reduced resistance to movement. It is to be noted that when the turbines are extended, the center of gravity of the vessel is beneath the underside of the hull because of the mass of the turbines and the mass of the water within said turbines. Further, upon addition to said turbine mass and water mass of the velocity vector relating to the speed of water traveling through the turbine plus the centrifugal force generated by the rotating blade groups, said turbines become gyroscopic in nature to maintain the vessel in an upright attitude.

Failsafe pantographic connection means incorporated in the elevator means simultaneously extend or retract the turbines in unison, even where said retraction is involuntary. Thus, for example, if one turbine were to strike an immovable object and thus be forced to a retracted state, the remaining turbine(s) would also retract simultaneously, and the shock of collision would be equally distributed. Such simultaneous retraction, of course, prevents the vessel from tipping over after such an accident. Preferable configuration of the elevator means is such that retraction of the turbines moves said turbines simultaneously upwardly and rearwardly. Correspondingly, of course, extension of the turbines moves said turbines simultaneously downwardly and forwardly in relation to the underside of the hull.

Referring now to operation of the preferred turbines above-described, because rotation velocities of the blade groups within the tunnels are independently controllable, as direction and speed properties of the water change after discharge of said water through one blade group, the velocity of rotation of the successive blade group can be set and adjusted accordingly to keep blade group speeds at an efficient magnitude, avoid cavitation, and simultaneously realize full water-volume pumping potential. As contrasted to prior art single speed blade rotation with single blade configuration, the unprecedented flexibility of the instant invention in treatment of water as it is pumped through the tunnels of the turbines represents a tremendous increase in attainable water volume movement. Additionally, since the blade groups are tandemly mounted in series in the same body (turbine), flat plate area of the turbine in relation to blade groups is divided by the number of blade groups disposed in the turbine. Thus, if there were only one blade group, for example, flat plate area charged to that blade group would be 100%. Conversely, with four blade groups, a mere 25% of the total flat plate area is charged to each blade group since all blade groups after the first have the same suction-to-discharge ratio and therefore perform the same amount of work as if each were operating independently of the others.

In the preferred turbine firstly-described above having first and second water intake tunnels, because of the expanding spiraling inwardly projecting angles of water exiting the two tunnels into the mixing chamber (said exiting flows being akin to respective frustra of cones), the water exiting the first tunnel and the water exiting the second tunnel collides in the mixing chamber at acute angles as measured from an imaginary longitudinal line through the turbine. On collision, however, a linear water path is established. Since this linear water path is not established by the turbine wall, nor is it connected or attached to the turbine and therefore is not a fixed vane, the vector forces of the water colliding at acute angles are additive as forces on said linear water path to thereby further increase flow velocity of water discharged from the tunnels.

In the preferred turbine secondly-described above having one water intake tunnel, means are provided for delivering additional water immediately aft of each respective blade group preferably at an angle in opposition to the angle of water discharged from the blade group so involved. The angular entry of this additional water has a straightening effect on the water discharged from the blade group and thus employs the principle above-recited in relation to the action in the mixing chamber of the firstly-described embodiment to promote linearity in the resultant water path. Delivery of the additional water, however, also increases the mass of water present for travel through the next succeeding blade group or, when aft of the final blade group, for travel through the venturi constriction and exit passages. Energy is the product of mass times velocity. Because a given plug of water discharged from a particular blade group is traveling at a higher velocity than its entry speed into said blade group, but yet is of the same mass, the only way greater energy can be derived through the next succeeding blade group, given the definition of "energy," is to add mass to said plug before it enters the next succeeding blade group or the venturi constriction passage situated after the final blade group. The delivery of additional water (mass) aft of each blade group, therefore, results in the production of more and more energy as the water travels through each successive blade group and finally to the venturi constriction passage. In a most preferred embodiment, means are included to deliver said additional water at essentially the same velocity as the velocity of the water exiting each particular blade group. When entry velocity of the additional water is such, it is evident that not only is the additional mass provided, but also that velocity of water discharged from each blade group is essentially fully maintained to thereby maximize efficiency.

In each of the turbine embodiments, means are provided in the exit passage to introduce gas under pressure into water passing there through. Like gas introduction can also occur with like means in the venturi constriction passage. This input of gas under pressure is of greatly significant importance since it adds force to the traveling water. Specifically, introduced gas (bubbles) expands to act as a piston on the inertial water. Water, of course, will not expand, but water-plus-gas, while not increasing in mass, will increase in volume. As the water-plus-gas exits the turbine, the gas bubbles expand to a much larger size as said gas displaces water and reduces back pressure as well as shock at the site of exit from the turbine. Such action creates an increase of piston effect, or, resultantly, a difference of forces between two bodies (turbine and water) which produces acceleration.

Alternatively, an additional venturi constriction passage can be included in the exit passage after gas under pressure has been introduced into the water. To deliver gas under pressure, said gas, of course, first must be compressed. Said compression results in the generation of heat (energy) which is then stored in the gas. Introducing this warm gas into the water results in re-expansion of said gas in the form of expanding bubbles and also results in these bubbles acting as miniature heat exchangers within the traveling water. Re-compression of the gas bubbles as they travel through an additional venturi constriction passage again results in imparting heat (energy) from the water to the bubbles prior to a final expansion as they exit the turbine along with the water in which they reside. In such manner at least some energy lost as heat through friction of the water within the turbine can be captured in the gas bubbles. Upon exit from the turbine, the heated bubbles re-expand, and the heat energy then released results in additional thrust or acceleration to the turbine.

Velocity, acceleration, deceleration, and straight-line movement of the vessel can be controlled by amount and variation of power to blade groups in the turbines. Thus, assuming for example one turbine being disposed beneath the right side of the hull and one turbine being disposed beneath the left side of the hull, a simultaneous identical increase, decrease, or constant water flow through each of said turbines accomplished by selected rotation speeds of appropriate blade groups results in acceleration, deceleration, or maintenance of velocity, respectively, of the vessel. Where means to control direction of water exiting the turbine are not included, increasing or decreasing water flow through one turbine only by selecting rotation speed(s) of appropriate blade groups in said one turbine of the two-turbine vessel above-described results in steering capabilities. Upward vertical pivoting of the forward end of one turbine will cause the vessel to bank, while such upward vertical pivoting of both turbines will cause the vessel to raise. When water-direction control means are included within the exit passages of the turbines, steering and attitude of the vessel can be accomplished by controlling direction of the path of water discharged from the turbines.

Employment of the preferred turbines results in movement of the vessel on a projectile principle, a principle believed unlike any currently embodied in water vessel movement. This unique projectile utilization is exemplified through a comparison of principles employed in a hover craft and in a hydrofoil craft, each of which operates with its underside above the water line. In these comparisons, then, with an assumed friction value of zero, a force of ten units applied in one direction (upwardly) to a hover craft results only in lifting the craft, and provides no forward motion. A force of ten units applied in one direction (linearly) to a hydrofoil craft with an assumed 45° angle of the foil results in only a five unit force in linear motion since, on vector consideration with the foil at 45°, five units (one-half of the force applied) must be used to lift the craft. In contrast, ten units of a projectile force applied to the instant vessel results in all ten units of force being utilized for linear motion while also simultaneously achieving a lifting of the underside of the vessel above the water line because of the projectile action.

Preferably, electric power is employed for operation of the vessel. While any of a variety of fuel sources, both fossil and non-fossil, can be called upon for generation of required electricity, a preferred source is that of a hydrogen fuel cell system. Such a system can generate electricity and heat, with the latter useful for supplying hot water for on-board use as well as useful for supplying low pressure steam usable to drive low pressure turbines which, in turn, can also produce electricity.

It is evident from the above disclosure that utility of the turbines is not limited to movement of a water-going vessel. On the contrary, said turbines can be employed as pumps for any substance which flows. Thus, as now would be apparent to the skilled artisan in view of the above disclosure, with appropriate screening means disposed at the site of intake, appropriately sized turbine components, appropriately chosen turbine component materials, and the like as examples, the turbines can find utility as clean-water pumps, sewage disposal pumps, and a multitude of other applications where flowable material must be moved from one site to another.

DETAILED DESCRIPTION OF PREFERRED EMBODIMENTS

Figure 1:
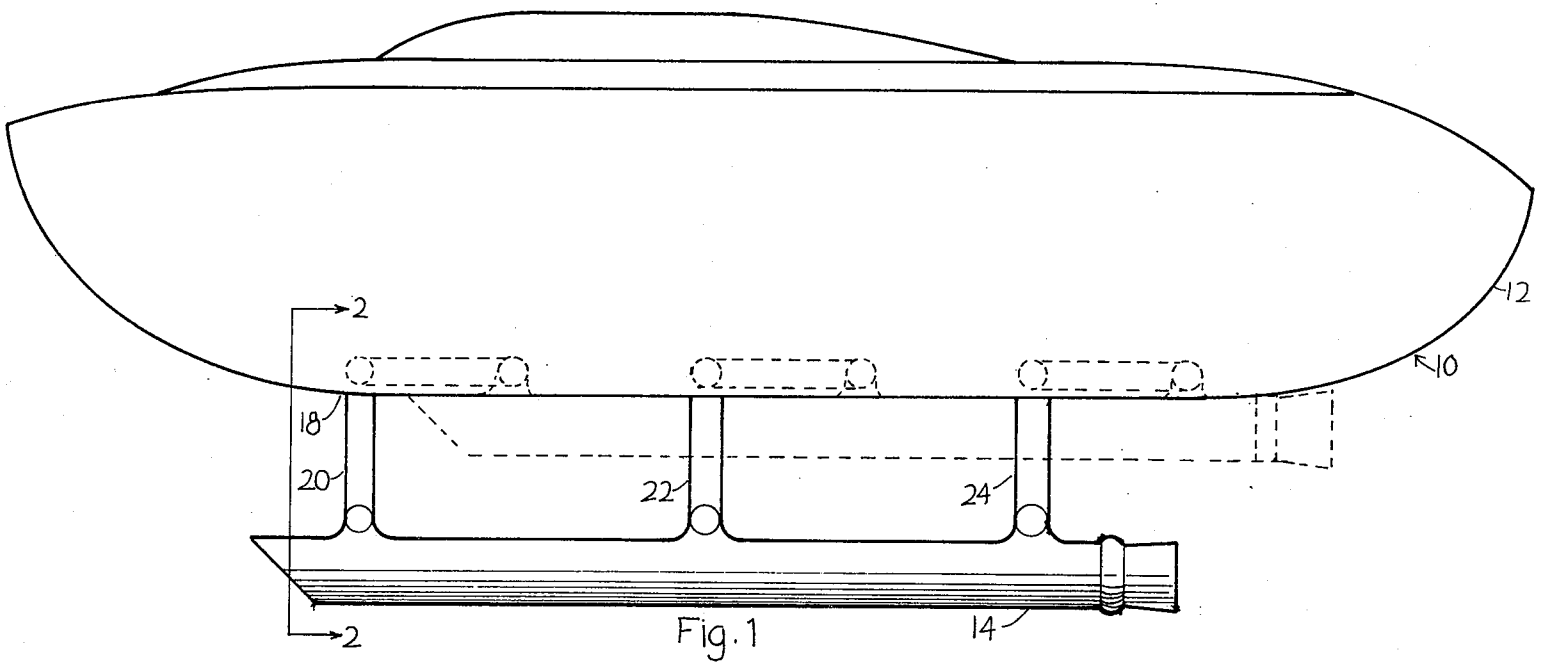
FIG. 1 is a side elevational view of a water-going vessel having two water intake turbines mounted on elevator means extending from the underside of the vessel.
Figure 2:
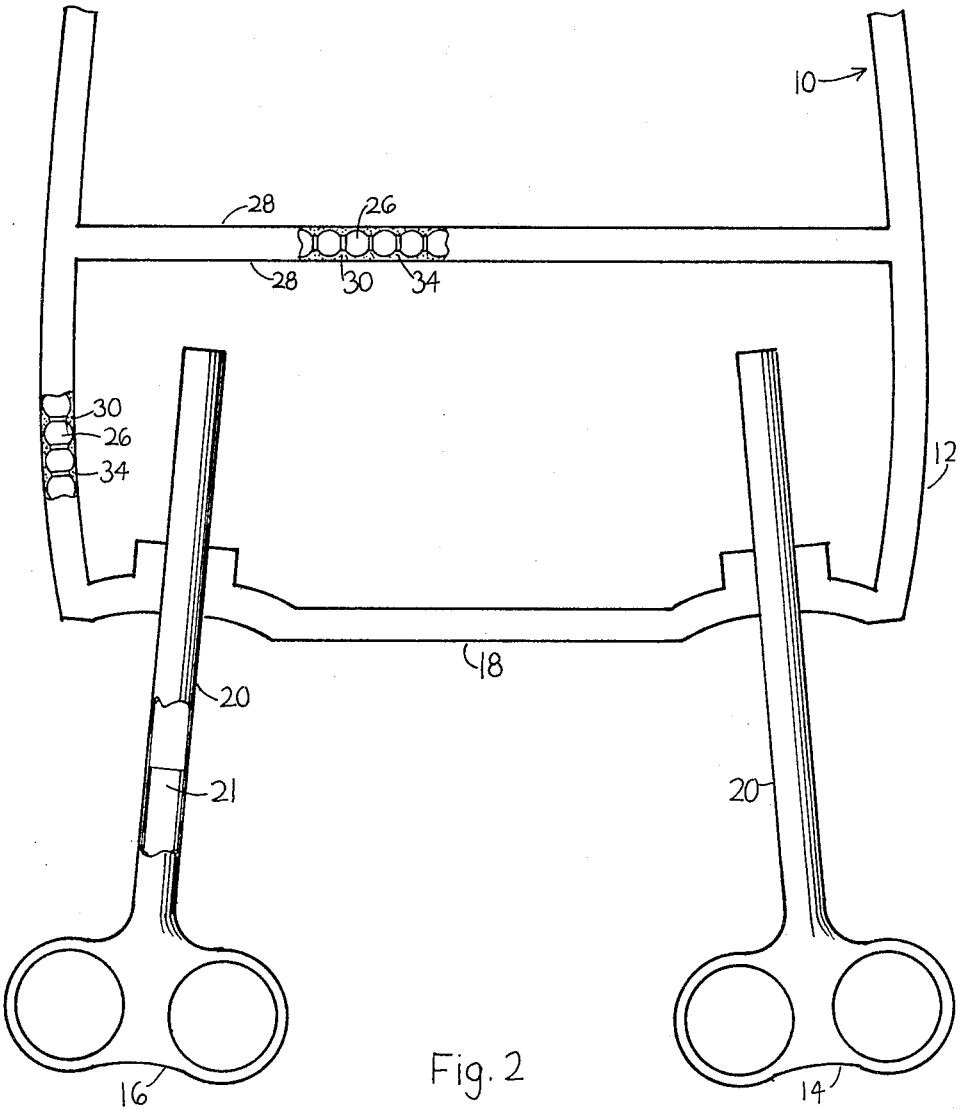
FIG. 2 is a sectional front elevational view of a portion of the vessel of FIG. 1 along line 2—2 thereof.

In FIGS. 1 and 2 is shown a water-going vessel 10 having a hull 12 and a first water intake turbine 14 and second water intake turbine 16 disposed beneath the underside 18 of the hull 12. Each of the turbines 14, 16 are mounted on elevator means here comprising exteriorly three arm members 20, 22, 24 to the first turbine 14 and three like arm members to the second turbine 16. The turbines 14, 16 are extended or retracted by operation of said arm members as will be discussed below in relation to FIGS. 3 and 4. Phantom lines show the position of said turbines in their retracted state.

FIG. 2, a sectional front elevational view of the vessel 10 along line 2—2 of FIG. 1, exemplifies hull construction as well as turbine placement. As to the former, construction pieces forming the hull 12 comprise a plurality of hollow spheres 26 sandwiched within containment walls 28 as shown in the cut-away end view. All adjacent spheres 26 are in contact with each other and are secured to each other by being welded to rings 30 which encircle each contact site of said spheres 26 with each other.

Additionally, each sphere 26 is secured to each touching containment wall 28 with plug welds provided in pre-formed holes in the containment walls 28. In the embodiment shown, the spheres 26, containment walls 28, and rings 30 are aluminum. Within the containment walls 28 closed-cell polystyrene foam 34 occupies all space not occupied by spheres 26. Said foam 34 has a density less than that of the aluminum spheres 26, and therefore, in addition to providing waterproofing and sound and heat insulation, provides added buoyancy for safety. It is to be understood that the presence of such filler material is not required for structural utility, and that, if used, can be chosen as appropriate as would be now recognized by the skilled artisan. Applicant's copending application Ser. No. 185,941, now abandoned, filed on even date herewith and entitled "Construction Panel," discloses various articles of construction utilizing such spherical principles. As is evident in FIG. 2, the turbines 14, 16 are extended, with the forward arm members 20 of the elevator means here visible. In the cut-away portion of the arm member 20 a shock absorber 21 is seen. Said shock absorber 21 is disposed in the forward arm member 20 to cushion travel, and has an identical counterpart disposed in the other forward arm member 20 of the other side of the vessel. The distance of extension of the turbines 14, 16 can be selected and maintained at any distance beneath the underside 18 throughout arm member travel. When said turbines are fully retracted, they nest in depressions 36 of the underside 18 of the hull 12. Construction of the turbines 14, 16 is discussed below in relation to FIGS. 5–7. Arm member disposition laterally is at an angle here of five degrees from the perpendicular. The turbine 14 is additionally vertically pivotally mounted to center arm member 22 for hydraulically-controlled vertical pivotal movement of said turbine 14 for control of the angle of approach of the forward end of said turbine. Within the first arm member 20 is disposed an air tube which leads from an on-board conventional compressed air tank and delivers air to the turbine 14 as later described. Within the center arm member 22 is disposed a cable carrying electricity from an on-board electric generation source for delivery to the motors within the turbine 14. Within the third arm member 24 is disposed a hydraulic-liquid tube for the service of hydraulically controlled apparatus within the turbine 14.

Figure 3:
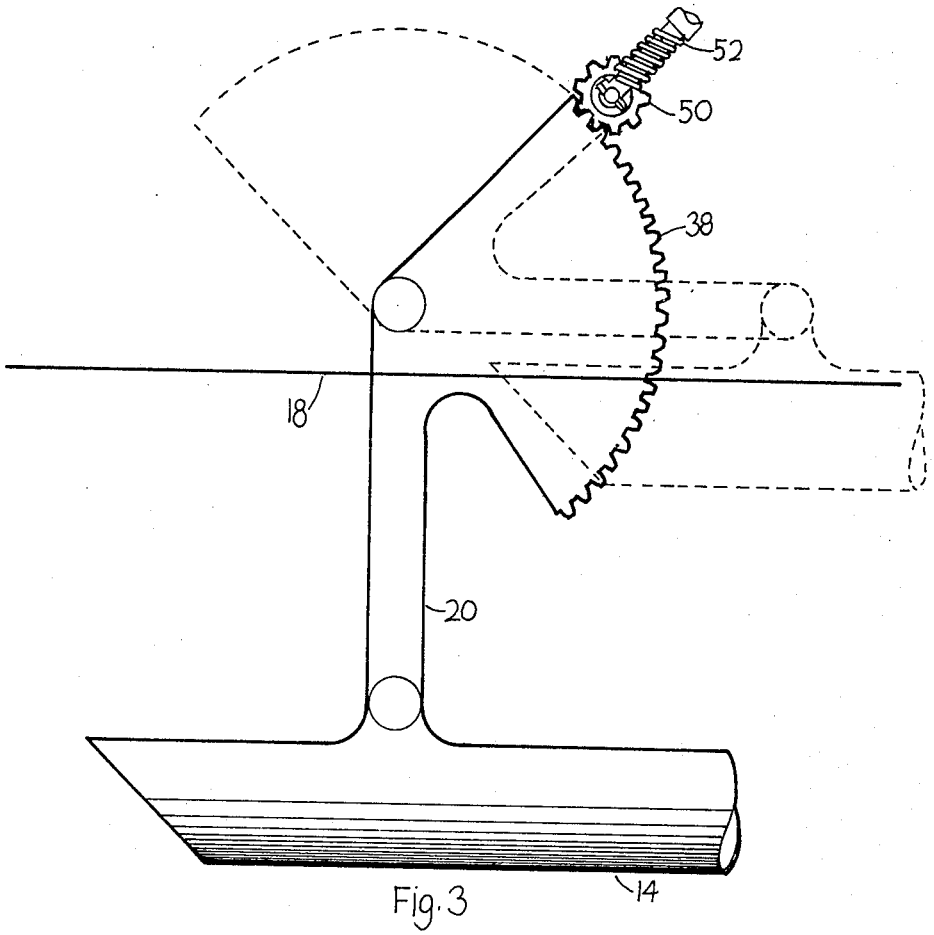
FIG. 3 is a partially sectioned side elevational view of the vessel of FIG. 1, showing a portion thereof.
Figure 4:
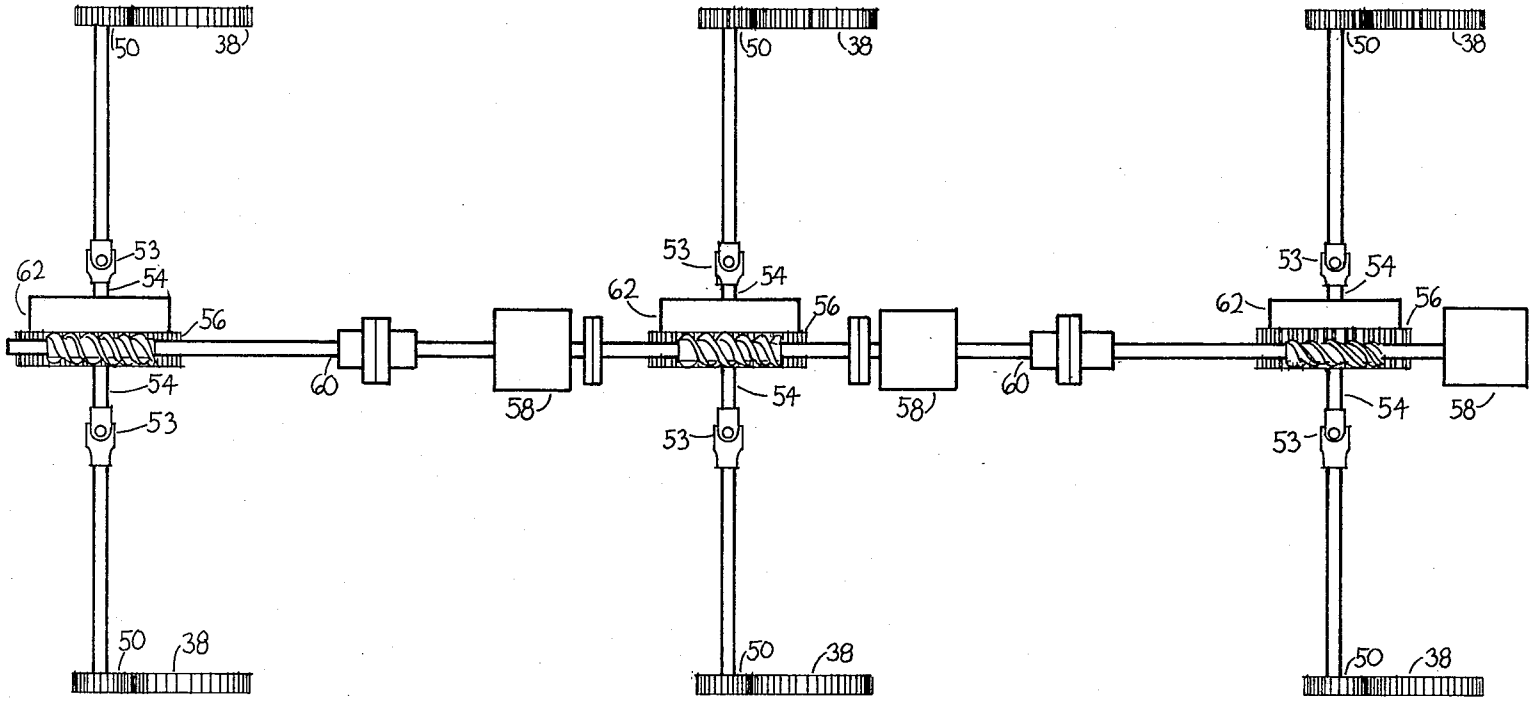
FIG. 4 is a top plan view, partially diagramatic, of the elevator means of the vessel of FIG. 1.

FIGS. 3 and 4 illustrate the elevator means of the vessel 10. As earlier recited, each of the turbines 14, 16 is mounted on three arms members 20, 22, 24. In the view shown in FIG. 3, only turbine 14 is shown, and, for clarity, only the first arm member 20 is shown. It is to be understood, however, that a like description also applies to turbine 16, and, likewise, arm members 22 and 24 have identical gearing apparatus. A conventional first gear means 38 is engaged with each arm member in the manner shown which results in retraction of the turbines in a simultaneously upward and rearward direction. Correspondingly, of course, extension of the turbines is in a simultaneously downward and forward direction.

The first gear means 38 are respectively engaged with second gear means 50 provided with spring-loaded pillow block bearing means 52 which, as known in the art, act to prohibit stripping of the first and second gears by squeezing out from each other on severe pressure. Universal joints 53 as known in the art are provided to accommodate the outward angle of the arm members 20, 22, 24. Transverse shafts 54 communicate as known in the art between each arm member gearing and central worm-and-gear means 56, with each pair of first, second, and third arm members 20, 22, 24 having individual interconnected drivers 58 plus one common driver 60 for extension and retraction. Respective friction clutches 62 are mounted to receive friction against the gears of the worm-and-gear means 56. In addition to simultaneously extending and retracting the turbines of the vessel, the elevator means is pantographically interconnected for safety purposes also. Thus, if one turbine strikes an immovable object and is thereby forced upwardly and rearwardly, the remaining turbine is also so moved simultaneously to prevent the vessel from tipping. In normal operation, activation of the gearing mechanism for extension or retraction is conventional. However, should a turbine strike an object, the force of said strike is transmitted throughout the elevator means. If the force is great enough to overcome the resistances of the friction clutches 62, the worm-and-gear means 56 become operative and all three pairs of arm members 20, 22, 24 are driven the same distance upwardly and rearwardly to thereby retract both turbines equally.

It is to be understood that utility of the elevator means above described is not limited to the turbine embodiment of turbines 14, 16, but that, instead, any turbine embodiment as well as any other type of apparatus extending from the underside of a water-going vessel can find beneficial utility in the elevator means described.

Figure 5:
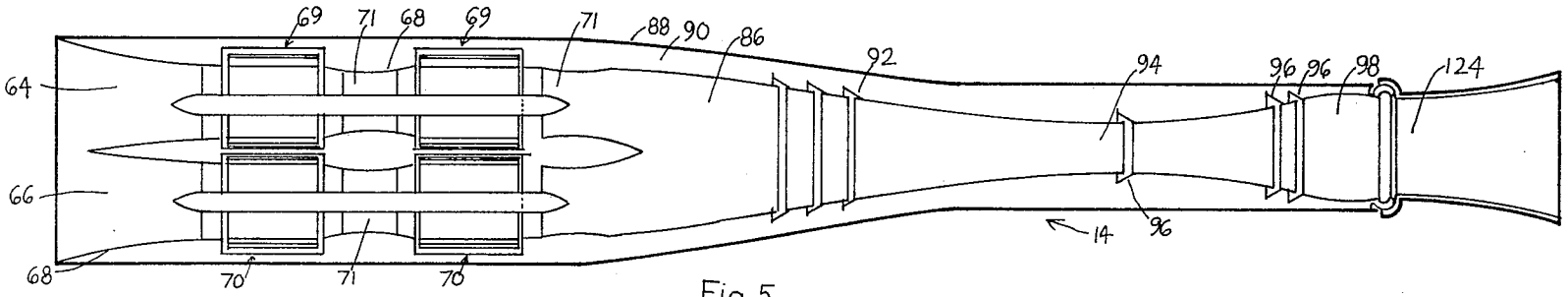
FIG. 5 is a top plan sectional view of one turbine of the vessel of FIG. 1.
Figure 6:
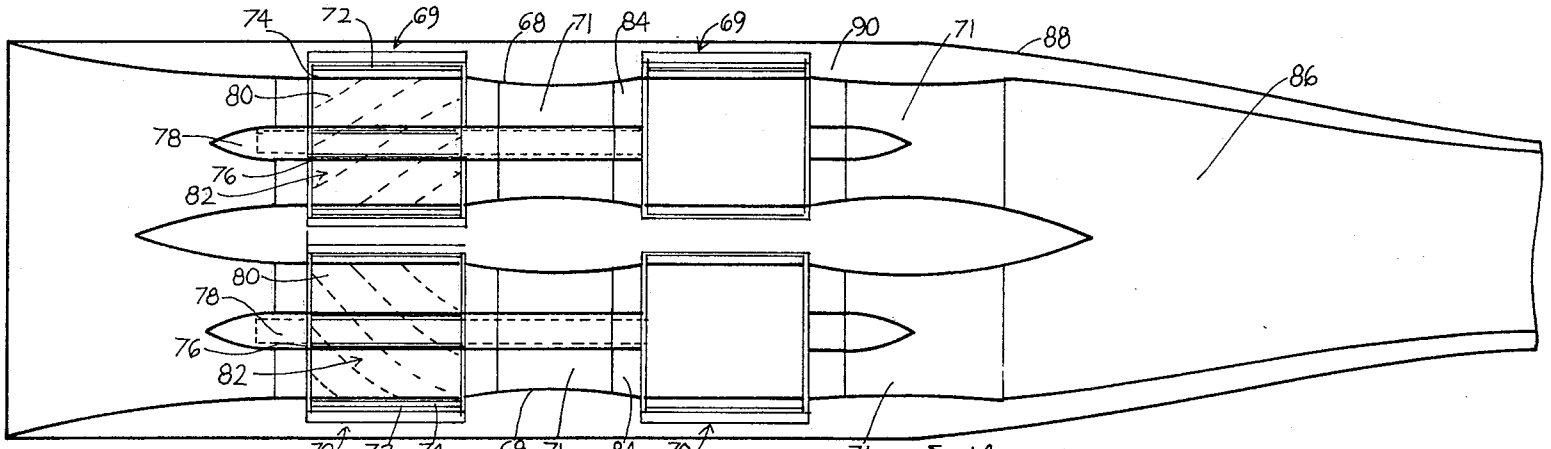
FIG. 6 is an exploded partial top plan sectional view of the turbine of FIG. 5.

FIGS. 5 and 6 are top plan views of one embodiment of a turbine 14, said embodiment incorporated in the views of FIGS. 1–3, with FIG. 6 being an exploded partial view of the forward portion of said embodiment.

A first water intake tunnel 64 and a second water intake tunnel 66 are parallel to each other within an inner turbine wall 68. Disposed within each tunnel 64, 66 are two independently controllable alternating current variable frequency submersible electric motors 69 and 70, respectively, spaced from each other in tandem and having a venturi constriction space 71 immediately aft of said motors 69, 70. Electric power to each of said motors 69, 70 is supplied from the cable earlier described and disposed within the center arm 22 of the elevator means. Each motor comprises a stator 72 and a rotor 74, said rotor having bearings in its central collar 76 as known in the art to rotate on a stationary shaft 78. Each motor 69, 70 is secured in place with its shaft attached to support vanes 84 attached to the inner wall 68 of the turbine. Said support vanes comprise three arms spaced equidistant from each other and radiating from the site of shaft attachment. These arms are also shaped as deflecting vanes to deflect water passing there around. Attached to each rotor 74 and radiating from its central collar 76 are a plurality of blades 80 to thus produce a blade group 82. The motors 69 in the first tunnel 64 have circuitry as known in the art to cause their blade groups 82 to rotate in one direction (e.g. clockwise), while the motors 70 in the second tunnel 66 have circuitry to cause their blade groups 82 to rotate in the opposite direction, thereby causing water exiting both the first tunnel 64 and second tunnel 66 to so exit at inwardly projecting angles. Aft of the first and second tunnels 64, 66 is a mixing chamber 86 where the above-noted angularly inwardly projecting water collides to then establish a linear water travel path. Between the inner wall 68 and outside wall 88 of the turbine 14 is a pressure chamber 90 to contain a gas, here air, under pressure. Said air is delivered to the pressure chamber 90 from an air tube as above noted. Annular openings 92 on the inner wall 68 and leading from the pressure chamber 90 into the aft portion of the mixing chamber 86 introduce air under pressure along said portion of the inner wall 68. Aft of the mixing chamber 86 is a venturi constriction passage 94 whose inner wall 68 has projecting therefrom air jet passages 96 leading from the pressure chamber 90 and introducing air under pressure into water traveling through the constriction passage 94. Aft of the constriction passage 94 is an exit passage 98 likewise having projecting from its inner wall 68 air jet passages 96 also leading from the pressure chamber 90 and introducing air under pressure into water passing through said exit passage 98.

Along the outside wall 88 of the turbine 14 annular openings 100 leading from the pressure chamber 90 introduce air under pressure along the length of said outside wall 88. When the turbines 14, 16 are extended, this air reduces friction between the water through which the turbines are traveling and the outside turbine wall 88. When the turbines 14, 16 are fully retracted, however, it is to be noted that the air issuing from the annular openings 100 tends to also travel along the underside 18 of the hull 12 (FIGS. 1 and 2) to likewise reduce friction along said underside. A water path thrust director 124 is disposed in the exit passage 98 and is described in detail in reference to FIG. 10, below.

Additional turbine embodiments are described below. It is to be understood that said additional embodiments can be used in the vessel, and, likewise, elevator means for said additional embodiments can be the same as is described above.

Figure 7:
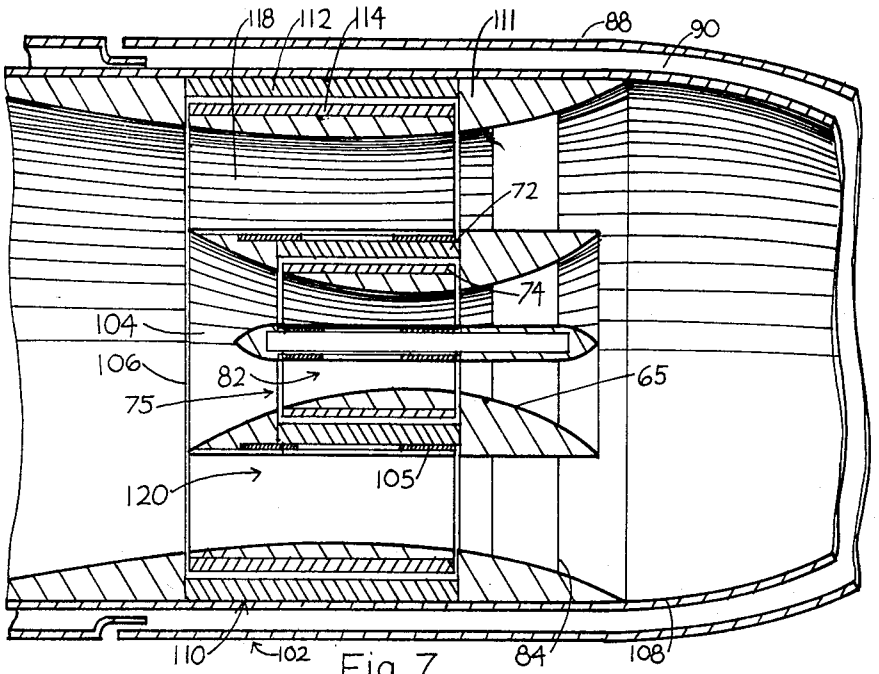
FIG. 7 is a partial top plan sectional view of a second embodiment of a turbine.

FIG. 7 is a partial top plan view of a second preferred embodiment of motor placement in a turbine 102. Said turbine 102 has two concentric tunnels 104, 106 within an inner turbine wall 108. In the full embodiment, the inner tunnel 104 has disposed therein two electric motors 75, operable and comprising the same components with like reference numbers as above-described for motor 70 of FIGS. 5 and 6, spaced from each other in tandem and having a venturi constriction space 65 immediately aft of each of said motors 75. In FIG. 7 one of said motors 75 is shown. Each motor 75 is secured in place with its shaft attached to support vanes 84 as described in relation to FIGS. 5 and 6. Disposed within the outer tunnel 106 in the full embodiment are two independently controllable alternating current variable frequency submersible electric motors 110 spaced from each other in tandem and having a venturi constriction space 111 immediately aft of each of said motors 110. In FIG. 7 one of said motors is shown. Each motor 110 comprises a stator 112 and a rotor 114, said rotor being rotatable via bearing means 105 on the stator 72 of the motor 75. Attached to the rotor 114 and radiating from its central collar 116 are a plurality of blades 118 to produce a blade group 120. The motors 110 are secured in placed via bearing attachment to the respective support vanes 84 as known in the art. The motors 75 have circuitry to cause their blade groups 82 to rotate in one direction while the motors 110 have circuitry to cause their blade groups 120 to rotate in the opposite direction, thereby causing water exiting both the inner tunnel 104 and outer tunnel 106 to so exit at inwardly projecting angles. Construction of the turbine 102 aft of its final blade groups 82, 120 is identical to that of the turbine 14 (FIGS. 5 and 6) aft of said turbine 14's final blade groups. Likewise, water behavior is identical aft of said blade groups in both turbine 14 and turbine 102.

Figure 9:
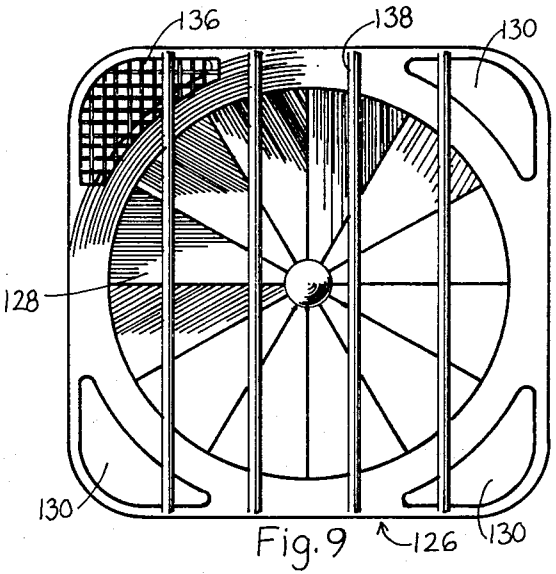
FIG. 9 is a front elevational view of the turbine of FIG. 8.
Figure 8:
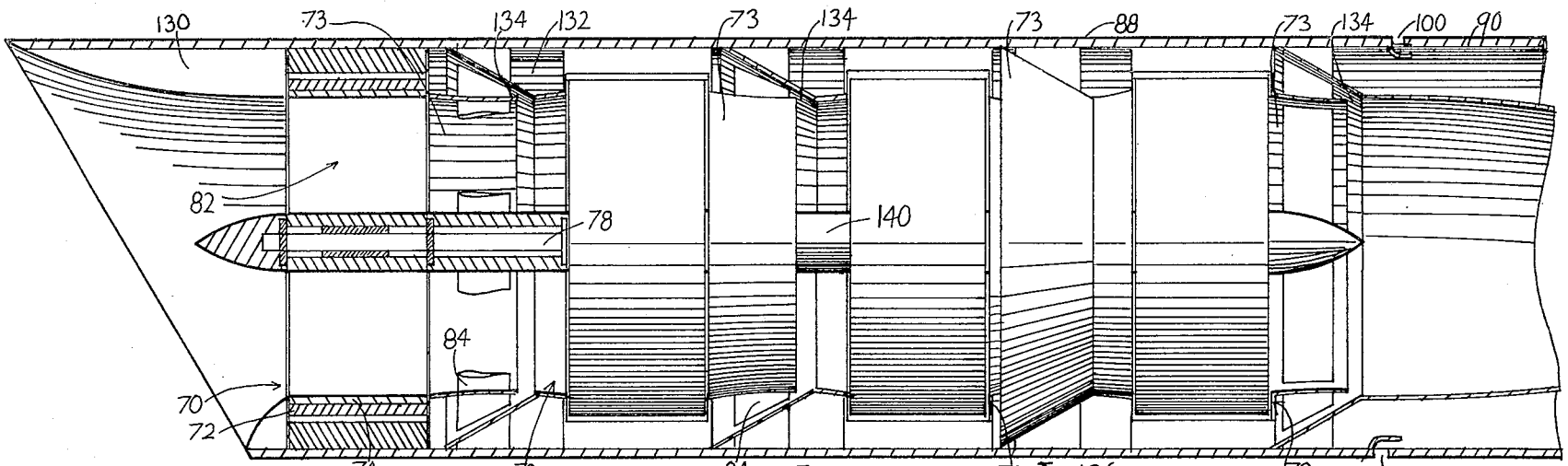
FIG. 8 is a partial top plan sectional view of a third embodiment of a turbine.

FIGS. 8 and 9 illustrate another preferred embodiment of a turbine 126, here showing the forward portion of said embodiment. The turbine 126 has a water intake tunnel 128 wherein are disposed four independently controllable alternating current variable frequency submersible electric motors spaced from each other in tandem and having a venturi constriction space 73 immediately aft of each of the blade groups 82 of said motor 70. The motors 70 are operable as above described for motors 70 of FIGS. 5 and 6, and comprise the same components with like reference numbers. The turbine 126 has means for delivering additional water immediately aft of each blade group, said means here being water intake channels 130 leading to an annular plenum chamber 132 and having leading from said plenum chamber 132 annular nozzles 134 to each venturi constriction space 73. As the turbine 126 travels through water, water enters the intake channels 130 and plenum chamber 132 at the velocity of turbine travel. Resultant water in the plenum chamber 132 is withdrawn therefrom through respective nozzles 134 immediately aft of each blade group 82 to satisfy mass requirements for entry into a next succeeding blade group 82 as discussed earlier in the Summary of the Invention section. Preferably, the nozzles are directed so that water entering therefrom enters at an angle in opposition to that spiraling angle of water discharging from a blade group to thus encourage a linear water travel path. A screen 136 can be included to protect each intake channel 130 from debris, while ribs 138 can be included to protect the intake tunnel 128 from objects which would be too large to pass through said tunnel.

Said ribs 138 can be included as desired on any of the turbines herein described, and are spaced as above noted in relation to the largest size of foreign matter which can be accommodated through respective tunnels. As in the embodiments of FIGS. 5–7, pressure chamber 90 delivers air through annular openings 100 on the outside wall 88 of the turbine 126. As is evident from FIG. 8, two stationary shafts 78 each carry two motors 70, with each of said shafts attached to support vanes 84 as described in relation to FIGS. 5 and 6. Such configuration is employed primarily for convenience since repair of an inner motor via entry between the first two and last two motors eliminates removal of a front or back motor for access to such inner motor. A sleeve 140 encompasses both shafts 78 so that uninterrupted water flow occurs. Construction of the turbine 126 aft of its final blade group 82 is identical to that of turbine 14 (FIGS. 5 and 6) aft of said turbine 14's mixing chamber 86.

Figure 10:
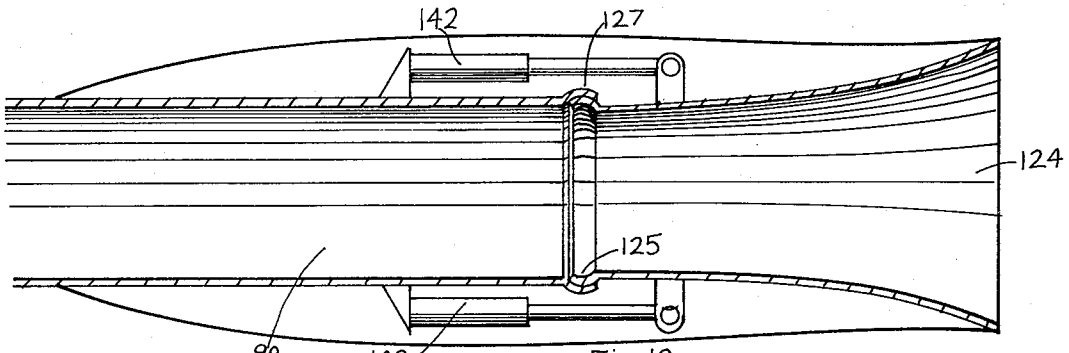
FIG. 10 is a side elevational sectional view of the exit passage of a turbine, including a water path director.
Figure 11:
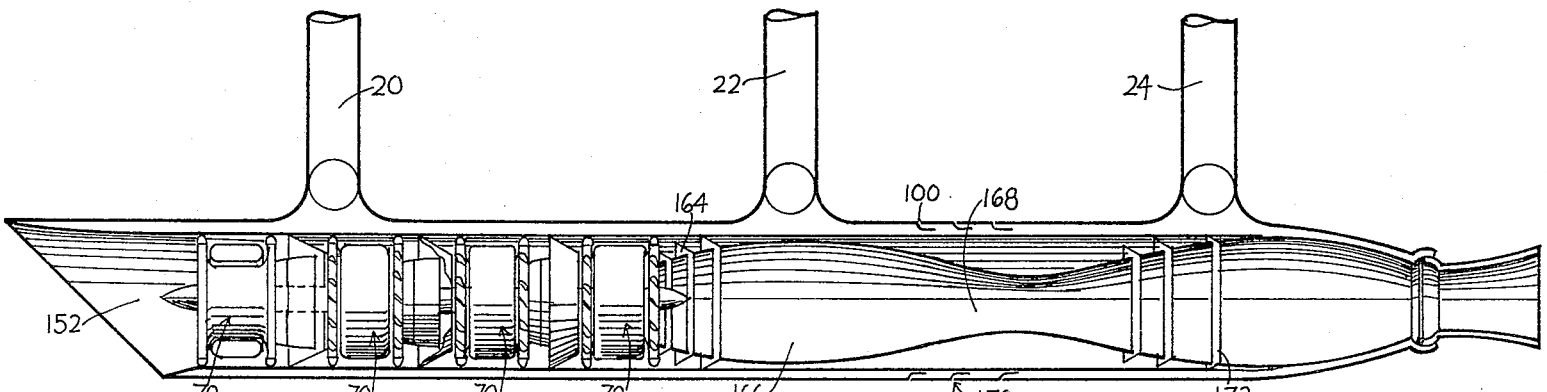
FIG. 11 is a side elevational view of a fourth embodiment of a turbine in section.

FIG. 10, a side elevational sectional view, illustrates a water path thrust director 124 disposed in the exit chamber 98. Said director 124 is operated hydraulically via hydraulic connectors 142 as known in the art, with spherical movement of the director 124 being accomplished. Hydraulic power is supplied from the tube as described above in relation to FIG. 3. As is evident from FIG. 10, the director 124 has a wall portion shaped as a ball 125 which operates in a sleeve-socket 127. Water emerging through the exit passage 98 of the turbine passes into the director 124 at the site of the ball 125 and then can be directed relative to exit path direction. In such manner the travel path of the vessel 10 can be controlled through control of the travel path of the exiting water.

In FIGS. 11 through 15 a fourth embodiment of a preferred turbine 150 is illustrated. Said turbine 150 has a water intake tunnel 152 wherein are disposed four independently controllable alternating current variable frequency electric motors 70 spaced from each other in tandem and having a venturi constriction space 73 immediately aft of each of the blade groups 82 of said motors 70. The motors are operable as above described for motors 70 of FIGS. 5 and 6, and comprise the same components with like reference numbers. The turbine 150 has means for delivering additional water aft of each respective blade group 82 at essentially the same velocity as the water being discharged from said respective blade group. Said means here illustrated for, firstly, delivering said additional water, comprises an annular water intake channel 154 leading to an annular plenum chamber 156 which surrounds the motors 70. To deliver said additional water at essentially the same velocity as that of water discharged from a respective blade group 82, the means here illustrated comprises a flywheel 158 mounted to the rotor 74 of each motor. The outer circumference of said flywheel 158 extends beyond the stator 72 both at the front and at the rear of said motor 70 and has a plurality of blades 160 projecting from its front circumferential surface and a plurality of blades 162 projecting from its rear circumferential surface. The blades 160 projecting at the front of the motor 70 are offset from the blades 162 projecting at the rear of the motor 70 to thereby reduce shock and shock noise of water traveling there through. Each blade 160, 162 is shaped like the tip of a propeller. As is evident, the blades 160, 162 of each respective motor 70 will rotate at the same speed as the inner blade groups 82, resulting in velocity of that water within the plenum chamber 156 being the same as that velocity of the water traveling through the blade group 82 and being discharged there behind. Annular nozzles 134 lead from the plenum chamber 156 to respective venturi constriction spaces 73 immediately aft of each of the first three blade groups 82. Through these nozzles 134 additional water traveling at essentially the same velocity as that of the water discharged from the particular blade group 82 enters immediately aft of said blade group. Nozzles 134 are as those described in relation to the embodiment illustrated in FIGS. 8 and 9, and preferably are directed so that water entering therefrom enters at an angle in opposition to that spiraling angle of water discharging from a blade group to thus encourage a linear water travel path. Aft of the final blade group 82 vaned nozzles 164 leading from the plenum chamber 156 introduce water therefrom at an angle in opposition to the angle of water discharging from the final blade group 82. Said water from the nozzles 164 then collides angularly with the water discharging from the final blade group in a reaction chamber 166 and establishes therein a linear water travel path on the principles of behavior described above in relation to the mixing chamber of the embodiment described in reference to FIGS. 5 and 6. Said collision and resultant linear water travel path is depicted with the spiraling and resultant straightened arrows shown in FIG. 13.

Figure 14:
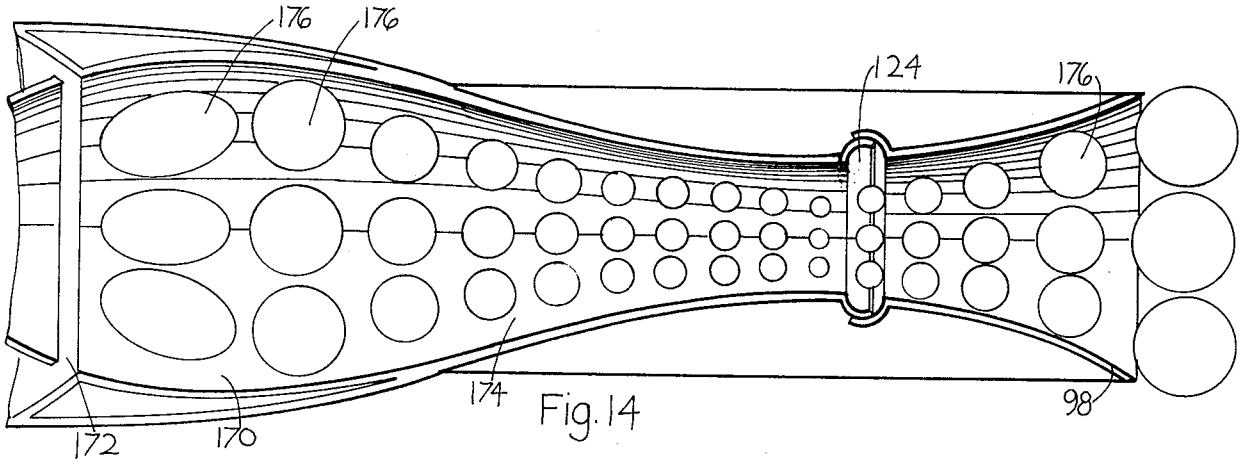
FIG. 14 is an exploded partial top plan sectional view of the third one-third of the turbine of FIG. 11.

Aft of the reaction chamber 166 is disposed a venturi constriction passage 168, followed by a linear passage 170 wherein air jet passages 172 leading from a pressure chamber 91 introduce air, preferably maintained warm after compression, under pressure into water discharging from the venturi constriction passage 168. A second venturi passage 174 is aft of the linear passage 170 and leads to an exit passage 98 wherein a water path thrust director 124 as described above in relation to FIG. 10 is situated. Warm compressed air is delivered to the pressure chamber 91 from on-board the vessel through entry tube 93, and a wall 95 can be disposed as shown to contain said warm air within the chamber 91. Preferably, all pipes and tubes carrying air as is known in the art to the chamber 91 are insulated to aid in maintenance of warm air. Bubbles 176 shown in progressive stages of expansion and contraction are shown in FIG. 14. A pressure chamber 89 forward of the pressure chamber 91 contains air under pressure for delivery through annular openings 100 disposed along the outside wall 88 of the turbine 150.

Figure 12:
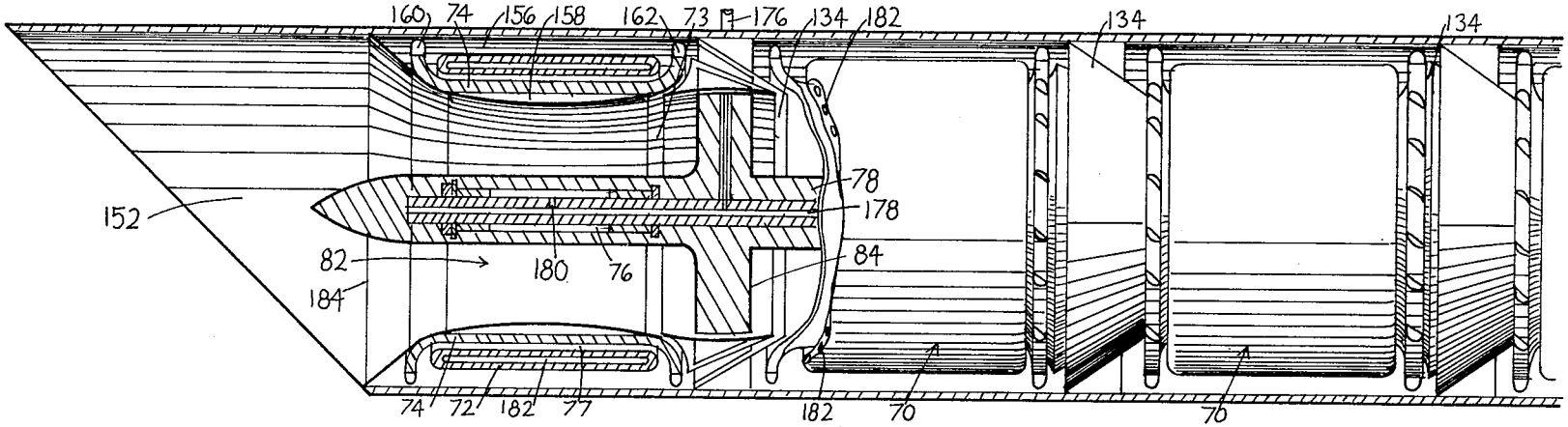
FIG. 12 is an exploded partial top plan sectional view of the first one-third of the turbine of FIG. 11.
Figure 13:
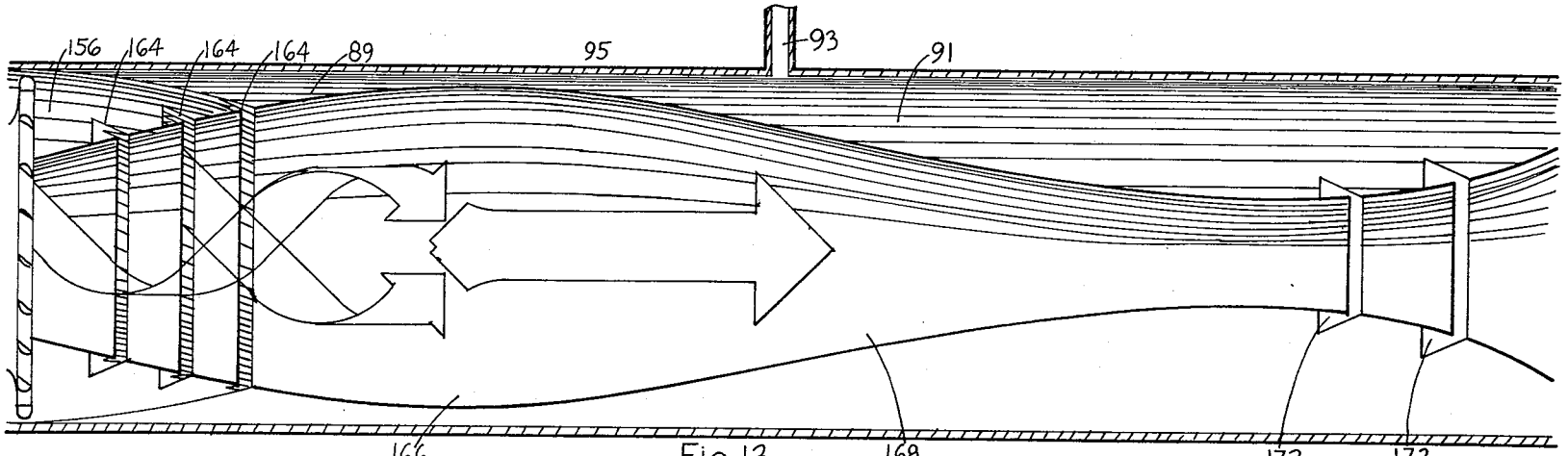
FIG. 13 is an exploded partial top plan sectional view of the second one-third of the turbine of FIG 11.
Figure 15:
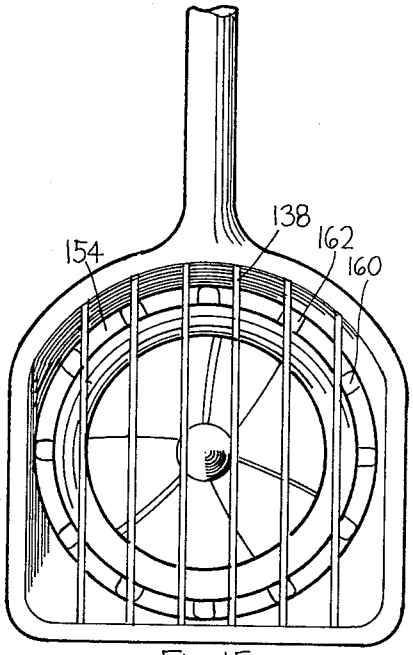
FIG. 15 is a front elevational view of the turbine of FIG. 11.

In FIG. 12, the first motor 70 is shown in cut-away fashion to illustrate said motor's construction. In all of the preferred embodiments of turbines herein described, motor construction, except for inclusion of the flywheel 158, is as here shown. It is to be understood, however, that, as would be recognized by the skilled artisan, various preferred components of said motors are present for efficiency or convenience, but may not necessarily be required for turbine operation and therefore are not meant to limit the scope of this invention. The motor here illustrated comprises a rotor 74 and a stator 72, with a gap 77 there between. It is to be noted that a nozzle supplying a gas, preferably air, can be included to introduce a jet of air into said gap 77. A stationary shaft 78 carries two motors 70, with said shaft attached to support vanes 84 as described in relation to FIGS. 5 and 6 and FIGS. 8 and 9. A lubricant can be introduced through tube 176 for travel through tube 178 and finally through tube 180 for lubrication of the bearings of the central collar 76 of said rotor 74. Within the windings of the stator 72 is disposed a network of tubes 182 having water or other liquid pumped there through for cooling of the stator 72. As would be recognized by the skilled artisan, said water or liquid can be pumped through said tubes 182 as a closed circuit with return to a cooling means prior to subsequent re-entry into the tubes 182.

A screen 184 can be included to protect the intake channel 154 of the turbine 150 from debris, while ribs 138 can be included to protect the intake tunnel 152, said ribs being spaced from each other in relation to the largest size of foreign matter which can be accommodated within the tunnel 152 without causing harm.

While several embodiments have been described above, it is to be understood that these embodiments are not limiting in regard to the scope of the instant invention. For sake of clarity of illustrations and brevity of text, it is to be understood that like reference numbers refer to like components throughout the various embodiments. Where exact descriptions relating to certain known components or procedures are not fully developed, it is to be understood that said components or procedures would be those as known to a skilled artisan.

The scope of the instant invention is now defined by the claims which follow.

What is claimed is:

1. A water-going vessel having a plurality of water intake turbines each of which is mounted on elevator means extending from the underside of the vessel, with each of said turbines additionally vertically pivotally mounted to said elevator means near the longitudinal midpoint of each turbine and having means for independent pivotal control, and further with the elevator means having failsafe pantographic connection means to each of said turbines for simultaneous extension and retraction of said turbines in unison.

2. A water-going vessel as claimed in claim 1 wherein each of the turbines comprises:

a. first and second water intake tunnels with each of said tunnels having disposed therein a plurality of individual tandemly disposed rotatable water-deflecting radiating blade groups spaced from each other with each blade group having immediately aft thereof a venturi constriction space and with each blade group having means to independently control individual rotation velocities thereof, and wherein in the first tunnel the blade groups rotate in one direction to expandingly spiral water in an inwardly projecting angle and in the second tunnel the blade groups rotate in the opposite direction to expandingly spiral water in an inwardly projecting angle;

b. a mixing chamber aft of the first and second water intake tunnels and wherein said angularly inwardly projecting water exiting from the first and second tunnels collides angularly and changes from radiating spiral motion to linear parallel motion;

c. a venturi constriction passage aft of said mixing chamber; and d. an exit passage aft of the venturi constriction passage, said exit passage having means to introduce gas under pressure into water passing there through.

3. A water-going vessel as claimed in claim 2 wherein the venturi constriction passage has means to introduce gas under pressure into water passing there through.

4. A water-going vessel as claimed in claim 2 wherein the aft portion of the mixing chamber has means to introduce gas under pressure along the surface of the wall of said aft portion.

5. A water-going vessel as claimed in claim 2 wherein the exit passage has disposed therein means to control direction of water exiting the turbine.

6. A water-going vessel as claimed in claim 2 wherein the exit passage has therein a venturi constriction passage.

7. A water-going vessel as claimed in claim 2 wherein the turbine has on its outside wall means to introduce gas under pressure along the surface of said outside wall.

8. A water-going vessel as claimed in claim 2 wherein the individual blade groups are each comprised of a plurality of blades attached to a rotor of an independently controllable alternating current variable frequency submersible electric motor having said rotor and a stator.

9. A water-going vessel as claimed in claim 8 wherein the stator has disposed therein heat exchange means to cool said stator.

10. A water-going vessel as claimed in claim 2 wherein the water intake tunnels are parallel to each other.

11. A water-going vessel as claimed in claim 2 wherein the water intake tunnels are concentric with each other.

12. A water-going vessel as claimed in claim 1 wherein each of the turbines comprises:

a. a water intake tunnel having disposed therein a plurality of individual tandemly disposed rotatable water-deflecting radiating blade groups spaced from each other with each blade group having immediately aft thereof a venturi constriction space and with each blade group having means to independently control individual rotation velocities thereof;

b. means for delivering additional water immediately aft of each respective blade group;

c. a venturi constriction passage aft of the final blade group; and d. an exit passage aft of the venturi constriction passage, said exit passage having means to introduce gas under pressure into water passing there through.

13. A water-going vessel as claimed in claim 12 wherein the venturi constriction passage has means to introduce gas under pressure into water passing there through.

14. A water-going vessel as claimed in claim 12 having means to deliver said additional water aft of each respective blade group at an angle in opposition to the angle of water discharged from said respective blade group.

15. A water-going vessel as claimed in claim 12 having means to deliver said additional water aft of each respective blade group at essentially the same velocity as that velocity of water discharged from said respective blade group.

16. A water-going vessel as claimed in claim 12 wherein the exit passage has disposed therein means to control direction of water exiting the turbine.

17. A water-going vessel as claimed in claim 12 wherein the exit passage has therein a venturi constriction passage.

18. A water-going vessel as claimed in claim 12 wherein the turbine has on its outside wall means to introduce gas under pressure along the surface of said outside wall.

19. A water-going vessel as claimed in claim 12 wherein the individual blade groups are each comprised of a plurality of blades attached to a rotor of an independently controllable alternating current variable frequency submersible electric motor having said rotor and a stator.

20. A water-going vessel as claimed in claim 19 wherein the stator of the motor has disposed therein heat exchange means to cool said stator.

21. A water-going vessel as claimed in claims 1, 2, or 12 wherein hull construction pieces of said vessel comprise a plurality of hollow spheres sandwiched within containment walls wherein adjacent spheres are in contact with each other, with each sphere of said plurality secured to said touching sphere adjacent thereto and further with each sphere which is in contact with a containment wall secured to said containment wall.

22. A water-going vessel as claimed in claim 21 wherein an inert filler material having a density less than that of the spheres occupies all space within the containment walls not occupied by spheres.

23. A water intake turbine comprising:

a. first and second water intake tunnels with each of said tunnels having disposed therein a plurality of individual tandemly disposed rotatable water-deflecting radiating blade groups spaced from each other with each blade group having immediately aft thereof a venturi constriction space and with each blade group having means to independently control individual rotation velocities thereof, and wherein in the first tunnel the blade groups rotate in one direction to expandingly spiral water in an inwardly projecting angle and in the second tunnel the blade groups rotate in the opposite direction to expandingly spiral water in an inwardly projecting angle;

b. a mixing chamber aft of the first and second water intake tunnels and wherein said angularly inwardly projecting water exiting from the first and second tunnels collides angularly and changes from radiating spiral motion to linear parallel motion;

c. a venturi constriction passage aft of said mixing chamber; and d. an exit passage aft of the venturi constriction passage, said exit passage having means to introduce gas under pressure into water passing there through.

24. A water intake turbine as claimed in claim 23 wherein the venturi constriction passage has means to introduce gas under pressure into water passing there through.

25. A water intake turbine as claimed in claim 23 wherein the aft portion of the mixing chamber has means to introduce gas under pressure along the surface of the wall of said aft portion.

26. A water intake turbine as claimed in claim 23 wherein the exit passage has disposed therein means to control direction of water exiting the turbine.

27. A water intake turbine as claimed in claim 23 wherein the exit passage has therein a venturi constriction passage.

28. A water intake turbine as claimed in claim 23 wherein the turbine has on its outside wall means to introduce gas under pressure along the surface of said outside wall.

29. A water intake turbine as claimed in claim 23 wherein the individual blade groups are each comprised of a plurality of blades attached to a rotor of an independently controllable alternating current variable frequency submersible electric motor having said rotor and a stator.

30. A water intake turbine as claimed in claim 29 wherein the stator of the motor has disposed thereon heat exchange means to cool said stator.

31. A water intake turbine as claimed in claim 23 wherein the water intake tunnels are parallel to each other.

32. A water intake turbine as claimed in claim 23 wherein the water intake tunnels are concentric with each other.

33. A water intake turbine comprising:

a. a water intake tunnel having disposed therein a plurality of individual tandemly disposed rotatable water-deflecting radiating blade groups spaced from each other with each blade group having immediately aft thereof a venturi constriction space and with each blade group having means to independently control rotation velocities thereof;

b. means for delivering additional water immediately aft of each respective blade group;

c. a venturi constriction passage aft of the final blade group; and d. an exit passage aft of the venturi constriction passage, said exit passage having means to introduce gas under pressure into water passing there through.

34. A water intake turbine as claimed in claim 33 wherein the venturi constriction passage has means to introduce gas under pressure into water passing there through.

35. A water intake turbine as claimed in claim 33 having means to deliver said additional water aft of each respective blade group at an angle in opposition to the angle of water discharged from said respective blade group.

36. A water intake turbine as claimed in claim 33 having means to deliver said additional water aft of each respective blade group at essentially the same velocity at that velocity of water discharged from said respective blade group.

37. A water intake turbine as claimed in claim 33 wherein the exit passage has disposed therein means to control direction of water exiting the turbine.

38. A water intake turbine as claimed in claim 33 wherein the turbine has on its outside wall means to introduce gas under pressure along the surface of said outside wall.

39. A water intake turbine as claimed in claim 33 wherein the individual blade groups are each comprised of a plurality of blades attached to a rotor of an independently controllable alternating current variable frequency submersible electric motor having said rotor and a stator.

40. A water intake turbine as claimed in claim 39 wherein the stator of the motor has disposed therein heat exchange means to cool said stator.

41. An alternating current variable frequency submersible electric motor comprising a stator and a rotor, said rotor having a central collar and having a plurality of blades each attached to the central collar and the rotor, and said stator having disposed therein heat exchange means to cool said stator, and further wherein a flywheel is attached to the rotor and wherein the outer circumference of said flywheel extends beyond the stator, said flywheel having a plurality of blades projecting from its circumferential surface.

* * * * *